United States Patent [19]

Edwards

[11] 4,329,798

[45] May 18, 1982

[54] TOOTH CONSTRUCTION FOR DIGGING BUCKETS

[76] Inventor: Gerald D. Edwards, Rte. 1, Box 15A, Dubberly, La. 71024

[21] Appl. No.: 173,253

[22] Filed: Jul. 29, 1980

[51] Int. Cl.[3] ..... E02F 9/28

[52] U.S. Cl. ..... 37/142 R; 299/91

[58] Field of Search ..... 37/141 R, 141 T, 142 R, 37/142 A; 172/719, 724, 766, 713, 730; D15/29; 299/91

[56] References Cited

U.S. PATENT DOCUMENTS

| | | | |
|---|---|---|---|
| D. 190,335 | 5/1961 | Livermore | 37/142 R |
| D. 207,448 | 4/1967 | Wilson | D15/29 |
| D. 207,451 | 4/1967 | Wilson | D15/29 |
| 790,724 | 5/1905 | Pearce et al. | 172/724 |
| 1,959,847 | 5/1934 | Van Buskirk | 37/141 T |
| 2,623,309 | 12/1952 | Frye | 37/142 R |
| 3,888,028 | 6/1975 | White | 37/142 R |
| 4,083,605 | 4/1978 | College et al. | 37/142 R X |
| 4,117,611 | 10/1978 | Hemphill | 37/142 R |

FOREIGN PATENT DOCUMENTS

| | | | |
|---|---|---|---|
| 723054 | 4/1980 | U.S.S.R. | 37/142 R |

*Primary Examiner*—E. H. Eickholt

*Attorney, Agent, or Firm*—James A. Wong

[57] ABSTRACT

A digger tooth for a power digging bucket or the like including an operating portion and an attachment portion, the operating portion comprising in combination:

a back wall having an upper end, a lower end, and an upper surface extending forwardly and downwardly from the upper end to the lower end;

a lower edge extending forwardly from the lower end of the back wall to a leading end;

first and second sidewalls extending upwardly and diverging from the lower edge to define an open cavity, the first and second sidewalls each having a rear edge integral with the back wall and a forward edge, the forward edges together defining a front end opening; and a wing-like flange extending laterally outwardly from each of the sidewalls from the respective upper edges thereof, each of the wing-like flange also merging at a trailing end thereof with the upper end of the back wall.

9 Claims, 5 Drawing Figures

TOOTH CONSTRUCTION FOR DIGGING BUCKETS

BACKGROUND OF THE INVENTION

1. Field of the Invention

This invention relates to an improved tooth construction for the pick-like teeth of digging buckets which include a plurality of teeth elements assembled on a lower surface thereof.

2. Description of the Prior Art

Of the prior art known to Applicant, U.S. Pat. Nos. 3,055,128; 4,028,823; Des. 215,953; and Des. 243,843 are believed to constitute the most relevant prior art with respect to the inventive concept disclosed and claimed herein. None of the prior art patents cited above show or suggest the novel features of the improved digger tooth construction described and claimed hereinbelow. Each of the patents listed above disclose digger tooth of known V-shape construction having a point with rearwardly extending, upwardly inclined upper edges along adjacent intersecting sidewalls. U.S. Pat. No. 4,028,823 also discloses an improved digger tooth construction having a pair of laterally spaced points formed along parallel outer walls and centrally directed inner walls.

SUMMARY OF THE INVENTION

With prior knowledge of the construction disclosed in the patents cited above, Applicant has devised the improved digger tooth construction disclosed herein to increase the material holding capacity of the bucket member in which the improved digger tooth is incorporated.

It is another object of this invention to provide an improved digger tooth construction which will shield and protect the lip of the bucket.

It is a further object of this invention to provide an improved digger tooth construction which in cooperation with other teeth of like construction will form a leading edge to take the brunt of the initial digging force.

It is yet another object of this invention to provide an improved digger tooth construction which will effect a better cut at the sides of a ditch and with greater facility.

It is, moreover, an object of this invention to provide an improved digger tooth construction which will enable a digger bucket to maintain and stay in any desired strata, such as in the case of a large drag bucket in a strip mining operation.

Still another object of this invention is to provide an improved digger tooth construction which will aid in knife-like rip-out and breakout actions, such as in wooded areas where roots are a problem or in frozen formations where the nose of the tooth will function as a pick and the wings will produce unheaval in ice structure.

Another object of this invention is to provide an improved digger tooth construction which will allow the digger bucket to maintain a more precise grade than possible with known digger tooth constructions.

An additional object of this invention is to provide an improved digger tooth construction which will enable a digger bucket to move more material in back-dragging operations.

BRIEF DESCRIPTION OF THE DRAWINGS

The disclosed invention will be more clearly understood when considered in view of the accompanying drawings in which.

DESCRIPTION OF THE PREFERRED EMBODIMENT

Figure 1:
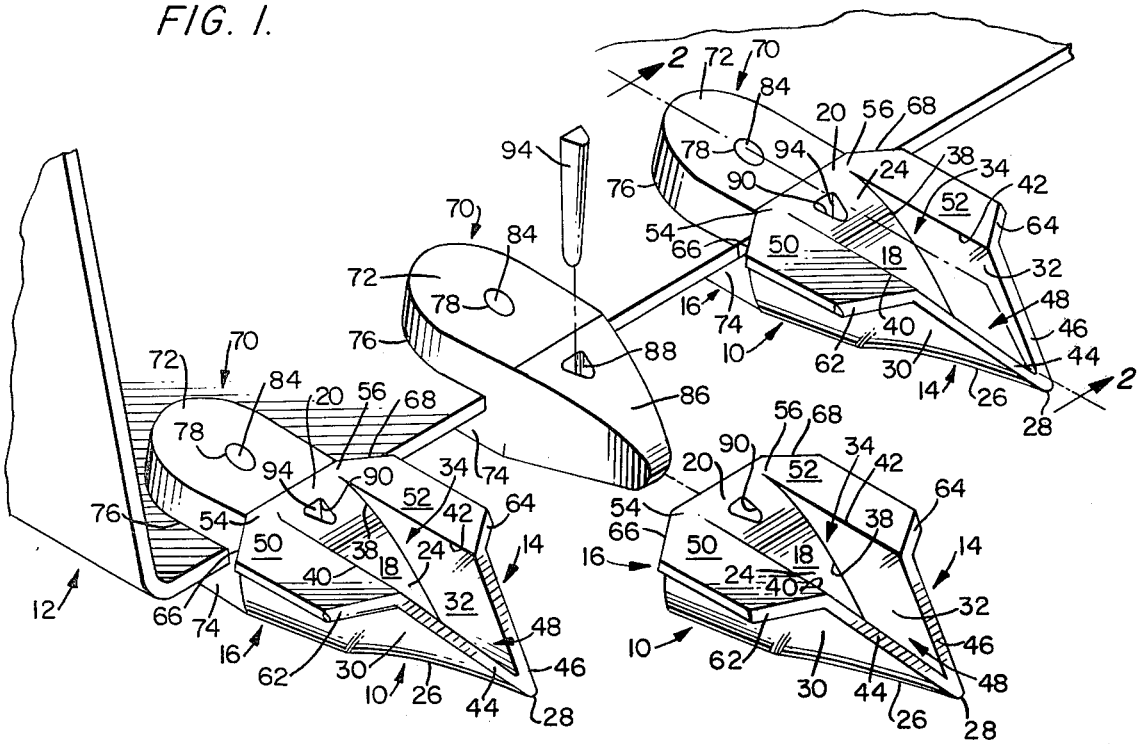
FIG. 1 is a view in perspective showing two digger tooth members, according to my inventive concept, assembled on a digger bucket with a third member in position to be assembled on the bucket.
Figure 2:
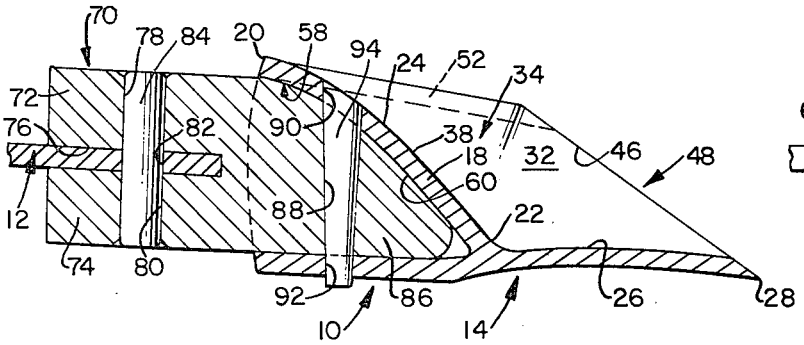
FIG. 2 is a sectional view taken through the plane 2—2 in FIG. 1 while looking in the direction of the arrows.

Referring now in detail to the drawings, the reader will readily appreciate in FIG. 1 a yet to be assembled digger tooth 10, according to this invention, is in position to be assembled on a digging bucket 12 like the other tooth members 10, 10 on opposite sides thereof. Each digger tooth 10, according to the present invention, for assembly on a power digging bucket 12 or the like includes an operating portion 14 and an attachment portion 16 with the operating portion 14 comprising in combination: a back wall 18 having an upper end 20, a lower end 22, and an upper surface 24 extending forwardly and downwardly from the upper end 20 to the lower end 22; a lower edge 26 extending forwardly from the lower end 22 of the back wall 18 to a leading end 28; first and second sidewalls 30, 32, respectively, extending upwardly and diverging from the lower edge 26 to define an open cavity 34, the first and second sidewalls 30, 32, each having a rear edge 36, 38 integral with the back wall 18, an upper edge 40, 42 and a forward edge 44, 46, the forward edges 44, 46 together defining a front end opening 48; and a wing-like flange 50, 52 extending laterally outwardly from each of the sidewalls 30, 32 from the respective upper edges 40, 42 thereof, each of the wing-like flanges 50, 52 also merging at a trailing end 54, 56 thereof with the upper end 20 of the back wall 18. The attachment portion 16 of digger tooth 10 as seen in FIGS. 2 and 5 comprises a socket 58 formed on a lower surface 60 of the back wall 18 on a side opposite from the upper surface 24 of the back wall 18 and facing rearwardly of the operating portion 14. As seen in FIG. 4, back wall 18 is generally in the shape of an isosceles triangle with upper end 20 being the base of such triangle. Each of the wing-like flanges 50, 52 forms an obtuse angle with the respective sidewall 30, 32 from which it extends in a plane above the horizontal, as may be readily seen in FIG. 3. Each of the wing-like flanges 50, 52 includes a leading edge 62, 64 extending rearwardly from the respective sidewall 30, 32 from which such wing-like flanges 50, 52 extend. Additionally, each of the wing-like flanges 50, 52 includes a trailing edge 66, 68 extending forwardly from the respective sidewall 30, 32 from which such wing-like flanges 50, 52 extend.

To enable or facilitate installation of each digger tooth 10 on digging bucket 12, a leading portion of which is illustrated as having been broken away from the major body portion not illustrated, an adapter lug 70 having rearwardly extending jaws 72, 74 spaced apart from each other by a slot 76, and a forwardly protruding nose portion 86 is provided for engagement with digging bucket 12. In accordance with the known practice, adapter lug 70 is applied to digging bucket 12 by clamping jaws 72, 74 over the floor of bucket 12 with the inner edge of slot 76 snug against the forward edge of the bucket floor, as may be seen in FIG. 2. Preformed apertures 78, 80 are provided in jaws 72, 74 so as to be brought into registration with a cooperating aperture 82 in the floor of bucket 12 for receiving retaining means in the form of bolts, pins 84, or the like. Socket 58 is adapted to be disposed over nose portion 86, which is provided with a bore 88. When socket 58 is firmly placed around nose portion 86 with preformed apertures 90, 92 provided on the walls of socket 58 in registration with bore 88, securing means such as pin 94 may be inserted through apertures 90, 92 and bore 88 to effect assembly of digger tooth 10 on bucket 12.

Figure 3:
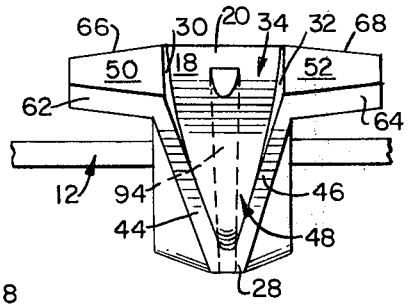
FIG. 3 is a front elevational view of the digger tooth illustrated in FIG. 2.
Figure 4:
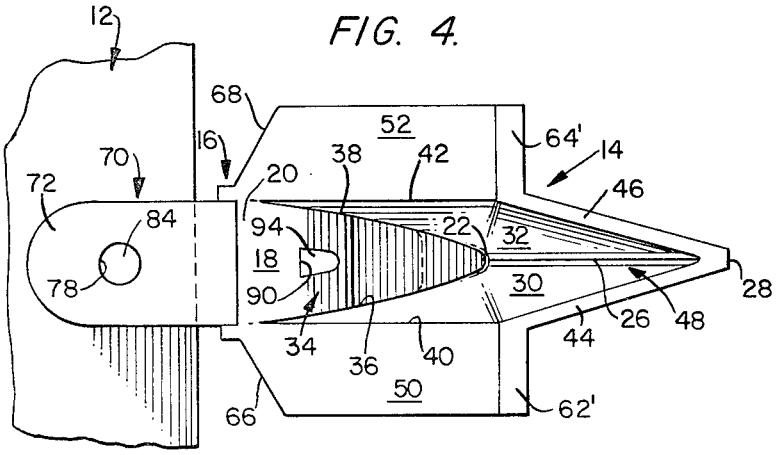
FIG. 4 is top plan view of the digger tooth illustrated in FIGS. 2 and 3 but with a modified version of the wing-like flange construction.
Figure 5:
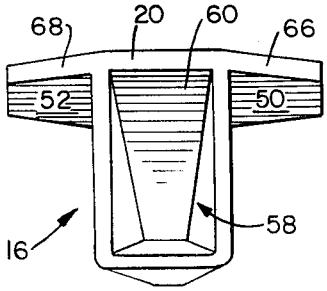
FIG. 5 is a rear elevational view of the yet unassembled tooth illustrated in FIG. 1.

While the digger tooth 10 illustrated in FIGS. 1 and 3 are formed with wing-like flanges 50, 52 of which the leading edges 62, 64 extend rearwardly from the respective sidewalls 30, 32, the digger tooth 10 modified within the inventive concept disclosed herein and illustrated in FIG. 4 is characterized in that leading edges 62', 64' of wing-like flanges 50, 52 extend transversely and outwardly from the respective sidewalls 30, 32 to provide square outside corners thereat to effect a different or improved cut of a ditch and/or the sides thereof. Other variations of the disclosed digger tooth 10 may be embodied in raising or lowering the wing position on the body as much as a quarter of an inch from that illustrated in the accompanying drawings. It is also within the contemplation of the inventive concept that length of wings may be modified so as to have increased and/or decreased length and/or width from the dimensions as illustrated. Also, the digger teeth 10 may be assembled on digging bucket 12 so that adjacent teeth 10 are in contact or almost in contact which will form a leading edge to take the brunt of the initial digging force and also shield and protect the lip of the bucket. From the foregoing description, it may be readily understood that the tooth construction with my improved wing-like flanges 50, 52, mounted on the corners or ends of the bucket, will cut the sides of a ditch much better than the conventional V-shape digger teeth. Further, the wing-like flanges may be formed or mounted in various positions and angles to the tooth to enable the bucket to be maintained in desired strata. The wing-like flanges may be formed so as to be sharp around the edges to provide knife-like, rip-out, and breakout actions. The wing-like flanges may be welded, molded, forged or even cast on the tooth body. The wing-like flanges may also be formed on relatively lower positions on the tooth body to enable the digging bucket to maintain a more precise grade or level than permitted by the conventional V-shape digger teeth.

It will be obvious to those skilled in the art that various changes may be made without departing from the scope of the invention and the invention is not to be considered limited to what is shown in the drawings and described in the specification.

What is claimed is:

1. A digger tooth for a power digging bucket or the like including an operating portion and an attachment portion, said operating portion comprising in combination:

a back wall having an upper end, a lower end, and an upper surface extending forwardly and downwardly from said upper end to said lower end;

a lower edge extending forwardly from said lower end of said back wall to a leading end;

first and second sidewalls extending upwardly and diverging from said lower edge to define an open cavity, said first and second sidewalls each having a rear edge integral with said back wall and a forward edge, said forward edges together defining a front end opening; and a wing-like flange extending laterally outwardly from each of said sidewalls from the respective upper edges thereof, each of said wing-like flange also merging at a trailing end thereof with said upper end of said back wall and extending forwardly to merge with the forward edge of the respective sidewall.

2. A digger tooth as defined in claim 1, wherein said attachment portion comprises a socket formed on a lower surface of said back wall on a side opposite from said upper surface of said back wall and facing rearwardly of said operating portion.

3. A digger tooth as defined in claim 1, wherein said back wall is generally in the shape of an isosceles triangle with said upper end being the base of such triangle.

4. A digger tooth as defined in claim 1, wherein each of said wing-like flanges forms an obtuse angle with the respective sidewall from which it extends.

5. A digger tooth as defined in claim 4, wherein each of said wing-like flanges extends from the respective sidewall associated therewith in a plane above the horizontal.

6. A digger tooth as defined in claim 1, wherein each of said wing-like flanges includes a leading edge extending rearwardly from the respective sidewall from which such wing-like flange extends.

7. A digger tooth for a power digging bucket or the like including an operating portion and an attachment portion, said operating portion comprising in combination:

a back wall having an upper end, a lower end, and an upper surface extending forwardly and downwardly from said upper end to said lower end;

a lower edge extending forwardly from said lower end of said back wall to a leading end;

first and second sidewalls extending upwardly and diverging from said lower edge to define an open cavity, said first and second sidewalls each having a rear edge integral with said back wall and a forward edge, said forward edges together defining a front end opening; and a wing-like flange extending laterally outwardly from each of said sidewalls from the respective upper edges thereof, each of said wing-like flange also merging at a trailing end thereof with said upper end of said back wall;

wherein each of said wing-like flanges includes a trailing edge extending forwardly from the respective sidewall from which such wing-like flange extends.

8. A digger tooth for a power digging bucket or the like including an operating portion and an attachment portion, said operating portion comprising in combination:

a back wall having an upper end, a lower end, and an upper surface extending forwardly and downwardly from said upper end to said lower end;

a lower edge extending forwardly from said lower end of said back wall to a leading end;

first and second sidewalls extending upwardly and diverging from said lower edge to define an open cavity, said first and second sidewalls each having a rear edge integral with said back wall and a forward edge, said forward edges together defining a front end opening; and a wing-like flange extending laterally outwardly from each of said sidewalls from the respective upper edges thereof, each of said wing-like flange also merging at a trailing end thereof with said upper end of said back wall;

wherein each of said wing-like flanges includes a trailing edge extending forwardly and a leading edge extending rearwardly from the respective sidewall that such wing-like flange extends.

9. A digger tooth for a power digging bucket or the like including an operating portion and an attachment portion, said operating portion comprising in combination:

a back wall having an upper end, a lower end, and an upper surface extending forwardly and downwardly from said upper end to said lower end;

a lower edge extending forwardly from said lower end of said back wall to a leading end;

first and second sidewalls extending upwardly and diverging from said lower edge to define an open cavity, said first and second sidewalls each having a rear edge integral with said back wall and a forward edge, said forward edges together defining a front end opening; and a wing-like flange extending laterally outwardly from each of said sidewalls from the respective upper edges thereof, each of said wing-like flange also merging at a trailing end thereof with said upper end of said back wall;

wherein each of said wing-like flanges includes a leading edge extending transversely and outwardly from the respective sidewall from which such wing-like flange extends to provide said wing-like flanges with square outside corners.

* * * * *